United States Patent [19]

Röck et al.

[11] Patent Number: 4,595,245

[45] Date of Patent: Jun. 17, 1986

[54] FASTENING DEVICE FOR FRONT PLATES OF DRAWERS OR THE LIKE

[75] Inventors: Erich Röck; Josef Brunner, both of Höchst, Austria

[73] Assignee: Julius Blum Gesellschaft mbH, Höchst, Austria

[21] Appl. No.: 624,966

[22] Filed: Jun. 26, 1984

[30] Foreign Application Priority Data

Jul. 19, 1983 [AT] Austria ..... 2638/83

[51] Int. Cl.[4] ..... F16B 12/00

[52] U.S. Cl. ..... 312/330 R; 312/111; 312/140; 248/243; 248/188.2

[58] Field of Search ..... 312/330 R, 334, 247, 312/111, 140; 248/188.2, 243

[56] References Cited

U.S. PATENT DOCUMENTS

| | | | |
|---|---|---|---|
| 1,055,522 | 3/1913 | Cumming | 248/243 |
| 1,254,094 | 1/1918 | Vogt | 248/243 |
| 2,350,155 | 5/1944 | Deal | 248/188.2 |
| 2,702,732 | 2/1955 | McCarran | 312/111 |
| 2,883,137 | 4/1959 | Weber | 248/243 |
| 2,928,512 | 3/1960 | Slater et al. | 248/243 |
| 2,979,857 | 4/1961 | Longbotham | 248/188.2 |
| 3,186,670 | 6/1965 | Perl | 248/188.2 |
| 3,610,720 | 10/1971 | Hosmer | 312/330 R |
| 3,752,553 | 8/1973 | Bildahl et al. | 312/111 |
| 4,090,753 | 5/1978 | Rock et al. | 312/330 R |

FOREIGN PATENT DOCUMENTS

| | | | |
|---|---|---|---|
| 2042328 | 9/1980 | United Kingdom | 312/330 R |

*Primary Examiner*—Victor N. Sakran

*Attorney, Agent, or Firm*—Wenderoth, Lind & Ponack

[57] ABSTRACT

A fastening device for adjustably fastening a front plate to a drawer includes holding parts arranged at the left and right sides of the front plate and engageable by means of screws into supporting parts secured to respective guide rails of the drawer. Flaps are pivotally mounted on the supporting parts and extend vertically to the front plate. Upper ends of the supporting parts are connected to the flaps by means of the screws. When the flaps are pivoted, the inclination of the front plate thereby is changed.

9 Claims, 3 Drawing Figures

FASTENING DEVICE FOR FRONT PLATES OF DRAWERS OR THE LIKE

FIELD AND BACKGROUND OF THE INVENTION

The invention relates to a fastening device for an adjustable front plate of an extractable furniture part, in particular for a drawer, the device including a supporting part fastened to each side of the furniture part, in particular to the guide rails of a pull-out guide assembly, and a holding part fastened to each side of the front plate. The holding parts and supporting parts at upper and lower bearing points thereof are attached to each other by means of screws or the like. The upper screws are held by flaps pivotably mounted on the supporting parts about axes extending parallel to the front plate.

DESCRIPTION OF THE PRIOR ART

It is the function of such fastening devices, which are in particular widely used in modern furniture construction, to provide means for fastening the front plates of a drawer or a pull-out shelf in a manner to enable adjustment and re-adjustment of the front plate in possibly three dimensions, so that in the case of tolerances variations, which may have been caused during mounting of the guide rail, the front plate can be aligned uniformly.

In spite of the adjusting possibilities, such a fitting should permit quick fitting and fixing of the front plate to the parts associated with the drawer. The fixing and adjusting means should be easily accessible.

In a fastening device according to the invention, the front plate should first be quickly fastenable to the drawer, and second it should be possible to adapt the fastening device in such a manner that in some way a zero position for the front plate is present. This means that it will generally be sufficient to fit the front plate into the supporting parts at the side of the drawer and to fasten them quickly.

Only if adjustment of the front plate becomes necessary must the required adjusting operations, which otherwise are not necessary, should be possible.

SUMMARY OF THE INVENTION

It is the object of the invention to simplify the adjustment or the setting of the zero position in a fastening device of this kind.

According to the invention this is achieved in that the flaps are vertically aligned to the front plate and the axes of the screws holding the holding parts to the supporting parts are aligned parallel to the front plate, and that between each supporting part and the flap is provided an adjusting member preferably designed as an eccentric.

One embodiment of the invention provides that each upper screw is mounted in a female thread in the holding part and extends through a slot in the respective flap, the width of which slot is slightly greater than the external diameter of the upper screws and through a slot in the holding part the which of which is wider than the slot in the flap.

Advantageously the flap and the eccentric are riveted to the supporting part.

BRIEF DESCRIPTION OF THE DRAWINGS

Below an embodiment of the invention will be described in more detail with reference to the accompanying drawings, wherein.

Figure 1:
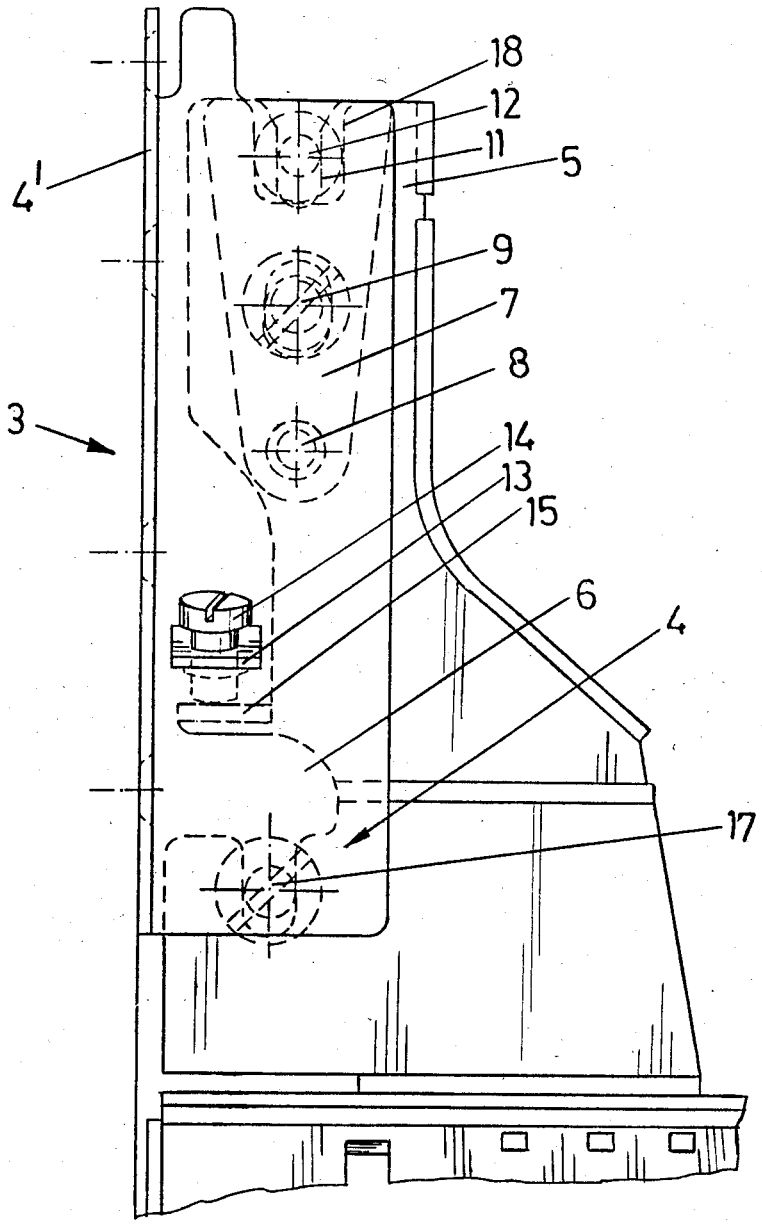
FIG. 1 is a side view of a fastening device according to the invention.

In the drawings, only one side of the fastening device is shown.

DESCRIPTION OF THE PREFERRED EMBODIMENT

As can be seen from a drawer includes, the drawer, a drawer bottom shelf 1 or provided with a guide rail 2 which has a Z-shaped profile and which carries at its front end a fastening device 3.

Figure 2:
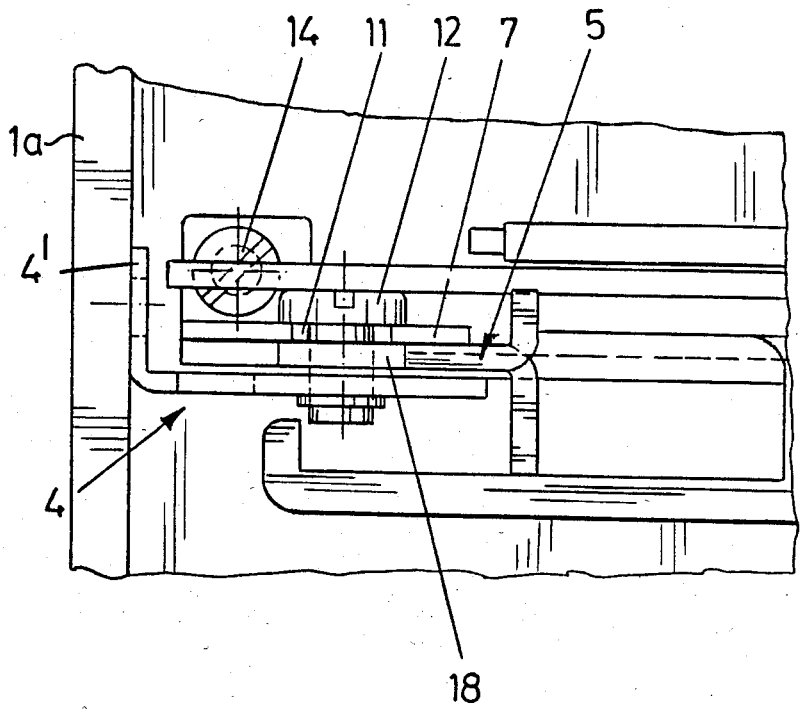
FIG. 2 is a top view of the fastening device according to the invention.
Figure 3:
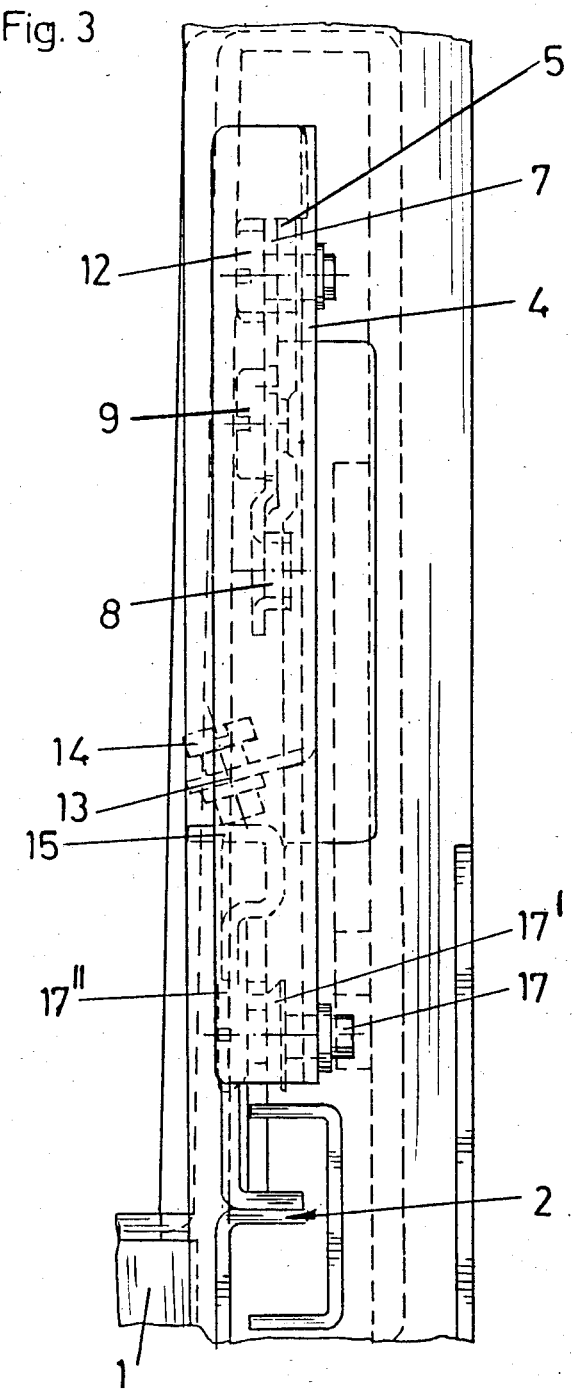
FIG. 3 is a vertical section through FIG. 1.

By means of the fastening device 3 a front plate 12 of the drawer is fastened to the drawer shelf 1 (see FIG. 2).

The fastening device 3 substantially comprises a holding part 4 and a supporting part 5.

The supporting part 5 is essentially a lateral strut which is aligned in the longitudinal direction of the guide rail 2 and directly fastened to the front end of the guide rail 2.

The supporting part 5 is aligned parallel to the side wall of the drawer. The holding part 4 has an angular flange 4' which is aligned parallel to the front plate and to which the front plate is fastened by means of screws.

In the fastening device 3, a bottom screw 12 is screwed into the upper end of the holding part 4 and a bottom screw 17 into the lower end thereof. A flap 13 is bent out of the center of the holding part 4, said flap having a female thread into which is threaded a bolt or screw 14 for vertical adjustment.

In the mounted position, the screw 14 abuts on a flap 15 which is bent out of the supporting part 5. When assembling the fastening device, the screw 14 is screwed into the flap 13 so that it projects by a certain distance. In this way a zero position for the vertical adjustment is automatically obtained when the holding part 4 is mounted onto the supporting part 5.

When mounting the front plate 12, the holding parts 4 are first screwed to the front plate, and then the front plate is pushed onto the supporting parts 5 by means of the holding parts 4, by inserting a respective upper screw 12 into a slot 18 in the respective supporting part 5 and into a slot 11 in a respective flap 7.

The lower screw 17 is pushed into an L-shaped recess 6 in supporting part 5 and is axially undisplaceably held thereon by means of a rim 17' and a head 17'' of screw 17.

The screw 14 abuts, as already mentioned, on the flap 15. The holding part at the opposite side of the drawer may, with the exception of the screw 17, be designed like the afore-described holding part 4. Instead of the lower screw 17, simply a flap bent out of the holding part 4 may be provided to form in the recess 6 a lower, front and rear stop but be laterally free. Due to this design it is sufficient to adjust the front plate laterally by turning the screw 17 at one side of the drawer because the fastening device at the other side of the drawer is laterally free and gives way i.e. the other holding part 4 is elastically resiliently drawn along.

The flap 7 is mounted on an axle 8 which may be formed by a rivet and is linked to the supporting part 5 by means of an eccentric 9. By turning the eccentric, the flap 7 is tilted relative to supporting part 5.

At the upper side the flap 7 is provided with a slot 11 which corresponds to the diameter of the screw 12. Hence, the screw 12 is laterally held in the flap 7. When the flap 7 is tilted relative to supporting part 5 by turning the eccentric 9, the front plate also is tilted by means of the screw 12 and the holding parts 4.

The extent or dimension of such tilting adjustment is limited by the width of the slot 18 in the supporting part 5.

After such adjustment, the screw 12 is tightened and thus clamps the holding part 4, the supporting part 5 and the flap 7 together, whereby the position of the front plate is finally and securely fixed.

To improve the fit between the individual parts, serrations may be provided.

What is claimed is:

1. A fastening device for use on opposite sides of an extractable furniture element for adjustably mounting a front plate on the furniture element, said fastening device comprising:

a supporting part adapted to be mounted on a front portion of the furniture element;

a holding part adapted to be mounted on the front plate;

means for connecting a lower portion of said holding part to a lower portion of said supporting part and to enable relative pivoting therebetween about a first axis extending parallel to the plane of the front plate;

a flap member mounted on said supporting member for pivotal movement relative thereto about a second axis extending parallel to the plane of the front plate, said flap member extending perpendicular to the plane of the front plate;

an adjusting member mounted between said supporting part and said flap member for selectively pivoting said flap member about said second axis;

an upper bolt having a longitudinal axis extending parallel to the plane of the front plate for connecting an upper portion of said holding part to an upper portion of said supporting part; and means for, upon operation of said adjusting member to pivot said flap member about said second axis, pivoting said holding member and thereby the front plate about said first axis, and thereby adjusting the inclination of the front plate relative to the furniture element.

2. A device as claimed in claim 1, wherein said lower portion connecting means comprises a lower bolt defining said first axis.

3. A device as claimed in claim 2, wherein said lower bolt is fixed to said lower portion of said holding part and extends through a lower slot in said lower portion of said supporting part.

4. A device as claimed in claim 3, wherein said lower slot opens upwardly.

5. A device as claimed in claim 3, wherein said lower bolt includes a head and a rim axially retaining therebetween said supporting part, and said lower bolt is threaded into said lower portion of said holding part, whereby rotation of said lower bolt moves said holding part and thereby the front plate laterally relative to said supporting part.

6. A device as claimed in claim 1, wherein said adjusting member comprises an eccentric.

7. A device as claimed in claim 1, wherein said pivoting means comprises said upper bolt being threaded into said upper portion of said holding part, first and second slots in said flap member and said upper portion of said supporting member, respectively, said upper bolt extending through said first and second slots, said first slot having a width slightly greater than the external diameter of said upper bolt, such that pivotal movement of said flap member moves said upper bolt and thereby said holding part, and said second slot having a width greater than said width of said first slot and thereby limiting movement of said upper bolt and thereby said holding part.

8. A device as claimed in claim 7, wherein said first and second slots open upwardly.

9. A device as claimed in claim 1, wherein said flap member is connected to said supporting member by a rivet defining said second axis.

* * * * *